US010280717B2

(12) United States Patent
Riley et al.

(10) Patent No.: US 10,280,717 B2
(45) Date of Patent: May 7, 2019

(54) DOWNHOLE TURBINE ASSEMBLY

(71) Applicant: Halliburton Energy Services, Inc., Houston, TX (US)

(72) Inventors: Benjamin Scott Riley, Houston, TX (US); Larry DeLynn Chambers, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 487 days.

(21) Appl. No.: 14/888,471

(22) PCT Filed: Dec. 9, 2014

(86) PCT No.: PCT/US2014/069311
§ 371 (c)(1),
(2) Date: Nov. 2, 2015

(87) PCT Pub. No.: WO2016/093805
PCT Pub. Date: Jun. 16, 2016

(65) Prior Publication Data

US 2016/0341012 A1 Nov. 24, 2016

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
(Continued)

(56) References Cited

U.S. PATENT DOCUMENTS 5,839,508 A 11/1998 Tubel et al.
7,201,239 B1 4/2007 Perry
(Continued)

FOREIGN PATENT DOCUMENTS

CN 200993072 12/2007
CN 202157766 3/2012
(Continued)

OTHER PUBLICATIONS

International Search Report and Written Opinion for PCT/US2014/069311 dated Aug. 13, 2015.
(Continued)

*Primary Examiner* — Matthew R Buck
*Assistant Examiner* — Patrick F Lambe
(74) *Attorney, Agent, or Firm* — Alan Bryson; C. Tumey Law Group PLLC

(57) ABSTRACT

A downhole turbine assembly includes a stator housing having one or more stator blades positioned within the stator housing and extending radially inward therefrom. A rotor shaft having a first end and a second end is rotatably positioned within the stator housing and has a first portion exhibiting a first diameter and a second portion exhibiting a second diameter greater than the first diameter. One or more rotor blades are secured to the second portion for rotation with the rotor shaft, and a first bearing assembly is positioned at the first end and a second bearing assembly is positioned at the second end. At least one of the bearing housings provides a primary flow path and a secondary flow path, and one or more radial bearings and one or more thrust bearings are arranged in the secondary flow path.

21 Claims, 2 Drawing Sheets

(58) Field of Classification Search
USPC ..... 166/244.1
See application file for complete search history.

(56) References Cited

U.S. PATENT DOCUMENTS

| | | | | |
|---|---|---|---|---|
| 7,204,326 | B2 | 4/2007 | Downie et al. | |
| 8,092,147 | B2 | 1/2012 | Draeger et al. | |
| 8,585,349 | B2 | 11/2013 | Winnacker | |
| 2005/0012340 | A1 | 1/2005 | Cousins | |
| 2005/0200210 | A1 | 9/2005 | Kotsonis et al. | |
| 2010/0243265 | A1 | 9/2010 | Sherrill et al. | |
| 2012/0091732 | A1 | 4/2012 | Fallet et al. | |
| 2012/0163743 | A1 | 6/2012 | Weber et al. | |
| 2014/0251592 | A1 | 9/2014 | Chen et al. | |
| 2014/0262524 | A1 * | 9/2014 | Valliyappan ..... | E21B 4/02 175/57 |

FOREIGN PATENT DOCUMENTS

| | | |
|---|---|---|
| CN | 203035072 | 7/2013 |
| WO | 2013130057 A1 | 9/2013 |

OTHER PUBLICATIONS

Chinese Examination Report for Application No. 201480083217.1 dated Sep. 21, 2018.
European Search Report for Application No. EP14907899 dated May 15, 2018.

* cited by examiner

DOWNHOLE TURBINE ASSEMBLY

BACKGROUND

Drilling of oil and gas wells typically involves the use of several different measurement and telemetry systems to provide data regarding the subsurface formation penetrated by a borehole, and data regarding the state of various drilling mechanics during the drilling process. In measurement-while-drilling (MWD) tools, for example, data is acquired using various sensors located in the drill string near the drill bit. This data is either stored in downhole memory or transmitted to the surface using assorted telemetry means, such as mud pulse or electromagnetic telemetry devices. Such sensors require electrical power and, since it is not feasible to run an electric power supply cable from the surface through the drill string to the sensors, the electrical power is often obtained downhole.

In some cases, for instance, the sensors may be powered using batteries installed in the drill string at or near the location of the sensors. Such batteries, however, have a finite life and complicate the design of the drill string by requiring a sub/housing that houses the batteries and associated sensor boards. Moreover, batteries take up a substantial amount of space in the drill string and can therefore introduce unwanted flow restrictions for circulating drilling fluid. In other cases, the sensors may be powered using an electrical power generator included in the drill string. For instance, a typical drilling fluid flow-based power generator employs a rotor shaft having multiple rotors extending radially therefrom. The rotors are placed in the drilling fluid flow path to convert the hydraulic energy of the drilling fluid into rotation of the rotor shaft. As the rotor shaft rotates, electrical power may be generated in an associated coil generator. In other applications, the rotational energy of the rotor shaft may be transmitted to various downhole devices, if desired.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is generally related to downhole drilling assemblies and, more particularly, to downhole turbine assemblies for power generation and/or device actuation.

The embodiments described herein provide downhole turbine assemblies that minimize bearing stack-up so that the bearing gap between the bearings and a polarity of rotors is minimized and, therefore, more easily controlled. The downhole turbine assemblies may include a stepped rotor shaft that helps avoid stacking through the turbine stages, which allows for smaller bearing gaps. Bearing assemblies arranged at one or both ends of the rotor shaft may include a bearing housing that provides a primary flow path and a secondary flow path, wherein one or more radial bearings and one or more thrust bearings may be arranged in the secondary flow path. A portion of a fluid circulating through the bearing housings may flow through the secondary flow path to lubricate and cool the radial and/or thrust bearings. Moreover, the bearing assemblies are preloaded against the rotor shaft as opposed to the rotor blades. As a result, the axial travel of the turbine may be minimized and the rotor blades can be lengthened and the gaps between axially adjacent rotor blades and stator blades can be shortened, thereby creating a more efficient downhole turbine assembly.

The downhole turbine assemblies described herein may be modular and otherwise handled as a single, transportable unit. The modular design and careful bearing stack-up allow the downhole turbine assemblies described herein to be assembled easily without the need for sensitive and time-consuming procedures, measuring, or shimming. As will be appreciated, this may help reduce assembly costs since sensitive procedures typically followed in conventional turbine assemblies are obviated and the likelihood for operator error is reduced.

Figure 1:
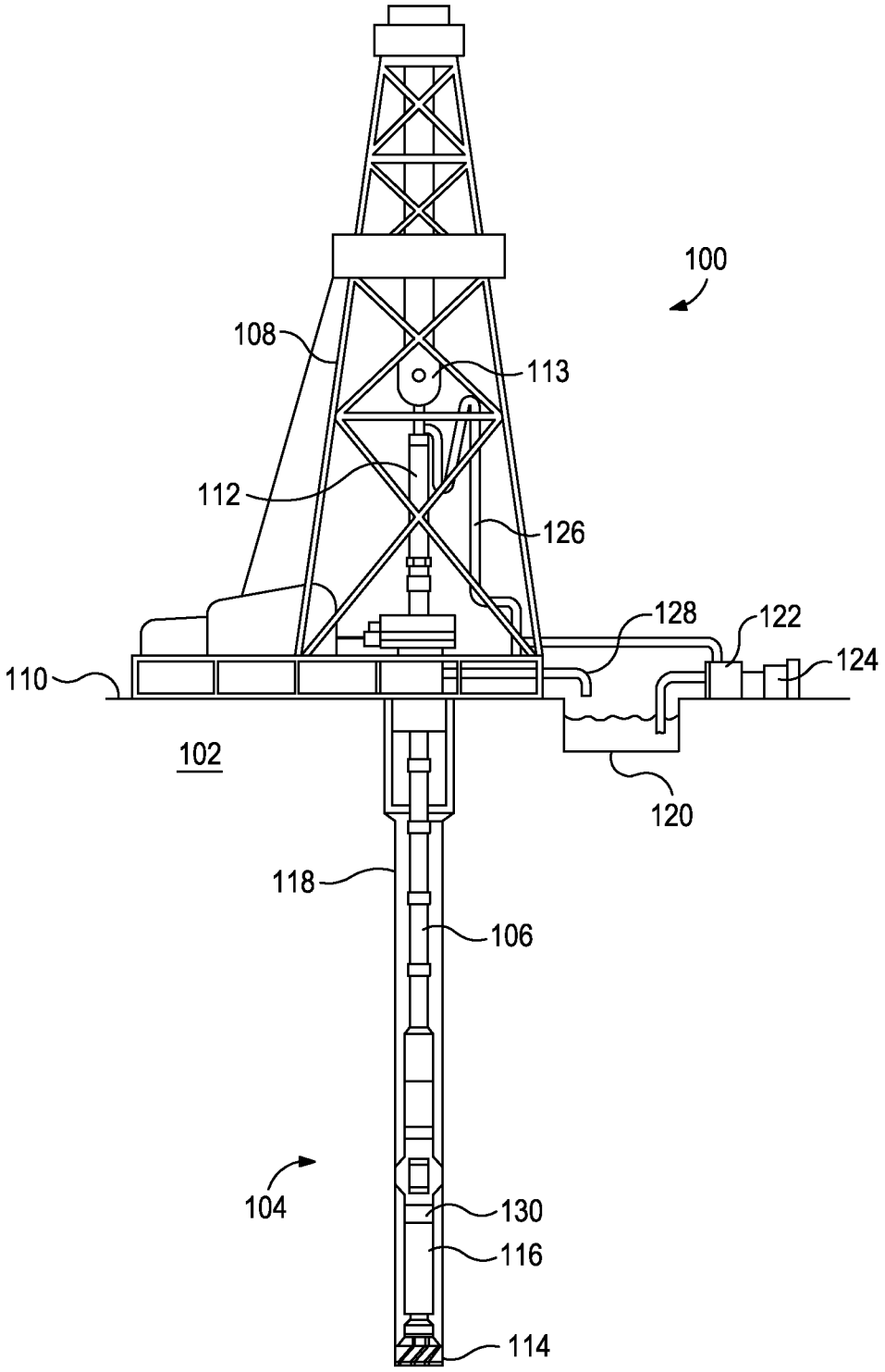
FIG. 1 is a schematic diagram of an exemplary drilling system that may employ the principles of the present disclosure.

Referring to FIG. 1, illustrated is an exemplary drilling system 100 that may employ one or more principles of the present disclosure. Boreholes may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick 108 arranged at the surface 110. The derrick 108 includes a kelly 112 and a traveling block 113 used to lower and raise the kelly 112 and the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process returns drill cuttings and debris to the surface. The cuttings and mud mixture are passed through a flow line 128 and are processed such that a cleaned mud can be returned down hole through the stand pipe 126 once again.

As illustrated, the drilling system 100 may further include a downhole turbine 130 arranged in the drill string 106 and, more particularly, in the tool string 116. The downhole turbine 130 may have a rotor shaft with one or more rotors extending radially therefrom. The rotors can be placed in a path of the drilling fluid as it circulates through the drill string 106, and thereby converting hydraulic energy of the drilling fluid into rotation of the rotor shaft. In some embodiments, rotating the rotor shaft may provide rotational energy used to actuate or otherwise rotate an adjacent downhole device or mechanism. In other embodiments, rotating the rotor shaft may generate electrical power in an associated coil generator, and the electrical power may be used to power adjacent electrical-consuming devices, such as sensors associated with the MWD and/or LWD tools, or a rotary steerable drilling tool.

Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Figure 2:
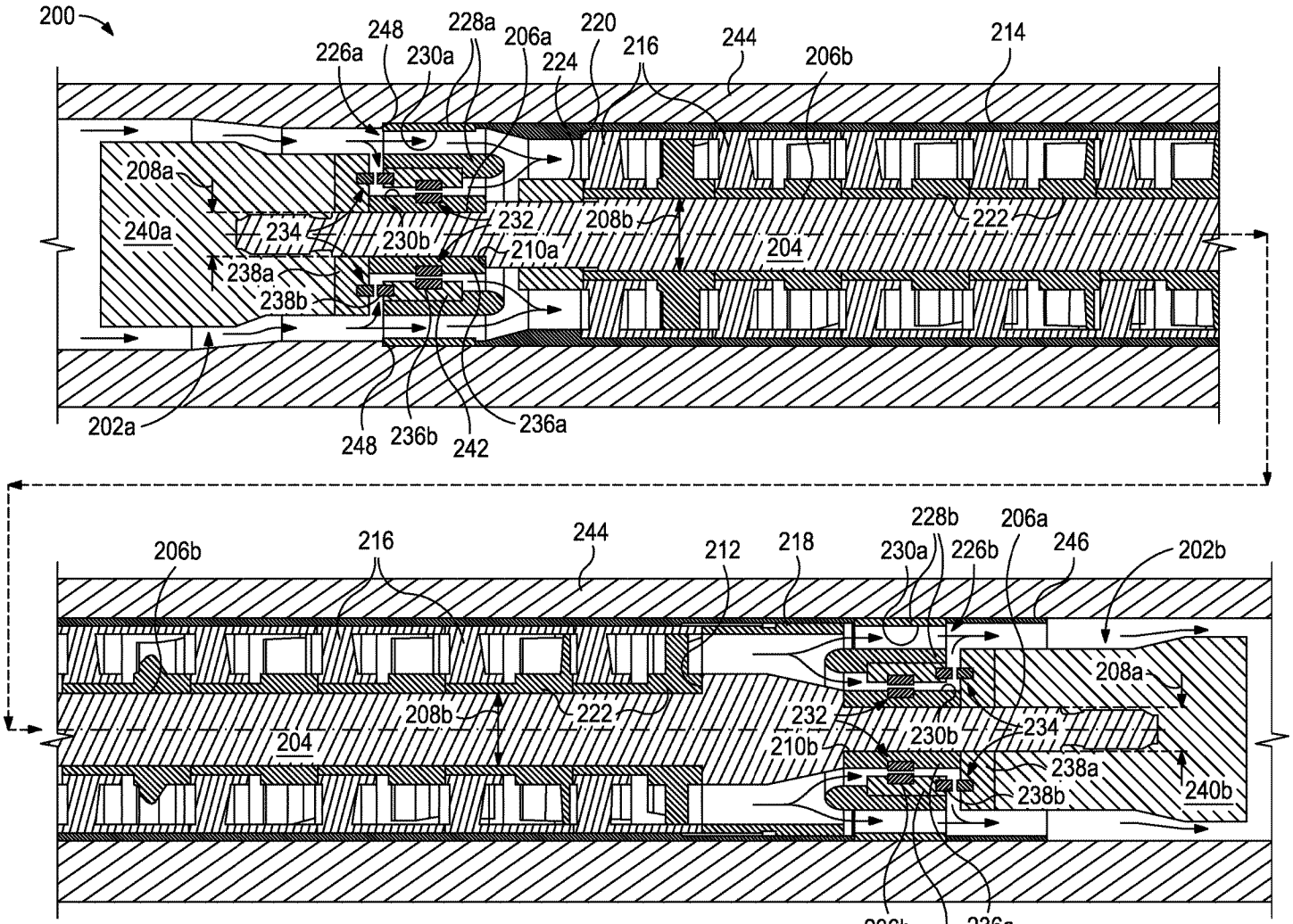
FIG. 2 is a cross-sectional side view of an exemplary downhole turbine assembly.

Referring now to FIG. 2, illustrated is a cross-sectional side view of an exemplary downhole turbine assembly 200, according to one or more embodiments. The downhole turbine assembly 200 (hereafter "the turbine assembly 200") may be similar in some respects to the downhole turbine 130 of FIG. 1, and therefore may form part of the tool string 116 (FIG. 1) and otherwise may be used in the drilling system 100 (FIG. 1). As illustrated, the turbine assembly 200 may have a first or uphole end 202*a* and a second or downhole end 202*b*. Fluid flow through the turbine assembly 200 may proceed generally from the first end 202*a* toward the second end 202*b*.

A rotor shaft 204 may extend between the first and second ends 202*a,b*. The rotor shaft 204 may be stepped and define or otherwise provide a first portion 206*a* and a second portion 206*b*. The first portion 206*a* may exhibit a first diameter 208*a* and the second portion 206*b* may exhibit a second diameter 208*b* that is smaller than the first diameter 208*a*. As illustrated, corresponding sections of the first portion 206*a* may be provided at each end 202*a,b* of the rotor shaft 204 such that the second portion 206*b* generally interposes the two first portions 206*a*. At the uphole end 202*a*, the first portion 206*a* may terminate at an upper bearing shoulder 210*a* defined on the rotor shaft 204. Similarly, at the downhole end 202*b*, the first portion 206*a* may terminate at a lower bearing shoulder 210*b* defined on the rotor shaft 204. The second portion 206*b* may terminate at a rotor shoulder 212 defined on the rotor shaft 204. In some embodiments, as illustrated, the upper bearing shoulder 210*a* may transition to the second portion 206*b* at or near the uphole end 202*a*.

The rotor shaft 204 may be rotatably positioned within a stator housing 214 that extends generally between the uphole and downhole ends 202*a,b* of the turbine assembly 200. A plurality of stator blades 216 may be positioned within and extend radially inward from the stator housing 214. In some embodiments, the stator blades 216 may be secured within the stator housing 214 using a stator lock ring 218 that preloads the stator blades 216 against a stator shoulder 220 defined on an inner radial surface of the stator housing 214. In some embodiments, the stator lock ring 218 may be threaded to the stator housing 214 and thereby place a compressive load on the stator blades 216 as they are forced axially against the stator shoulder 220. As a result, the stator blades 216 may be secured against rotation with respect to the stator housing 214 during operation of the turbine assembly 200.

The turbine assembly 200 may also include a plurality of rotor blades 222 positioned on and extending radially from the second portion 206*b* of the rotor shaft 204. The rotor blades 222 may be interleaved with the stator blades 216 such that a plurality of turbine stages are provided, where each turbine stage includes a stator blade 216 and a succeeding, axially adjacent rotor blade 222. In some embodiments, the rotor blades 222 may be secured to the second portion 206*b* of the rotor shaft 204 using a rotor lock ring 224 that may be threaded to the rotor shaft 204 and thereby place a compressive load on the rotor blades 222 as they are forced axially against the rotor shoulder 212. As a result, the rotor blades 222 may be secured against rotation with respect to the rotor shaft 204.

In addition to using the rotor lock ring 224, or as an alternative thereto, the rotor blades 222 may be secured and otherwise operatively coupled to the rotor shaft 204 via a variety of other means or methods, without departing from the scope of the disclosure. For instance, in some embodiments, one or more of the rotor blades 222 may be keyed to the rotor shaft 204, such as through a stem (or similar device) that extends from a given rotor blade 222 into a corresponding cavity (or similar aperture) defined in the rotor shaft 204. In other embodiments, the rotor shaft 204 may exhibit a polygonal cross-sectional shape where the rotor shaft 204 is, for example, hexagonal, and the rotor blades 222 may be configured to mate with or otherwise fit on the hexagonally-shaped rotor shaft 204. As will be appreciated, a polygonally-shaped rotor shaft 204 may prevent rotation of the rotor blades 222 with respect to the rotor shaft 204. In yet other embodiments, axially adjacent mating faces of the rotor blades 222 may interlock or may otherwise be configured to prevent relative rotation or movement. For instance, axially adjacent mating faces a given pair of rotor blades 222 may be castellated to prevent relative rotation. In even further embodiments, the rotor blades 222 may be secured to the rotor shaft 204 by shrink fitting, using one or more mechanical fasteners (e.g., screws, bolts, pins, lock rings, etc.), by welding or brazing, or any combination of the foregoing methods and/or means.

In at least one embodiment, the stator blades 216 and/or the rotor blades 222 may be clocked. In such embodiments, axially-successive stator blades 216 and/or rotor blades 222 may be angularly offset from each other such that they are staggered with respect to each other. Clocking the stator blades 216 and/or the rotor blades 222 may prove advantageous in improving the efficiency of the turbine assembly 200.

The turbine assembly 200 may further include a first or upper bearing assembly 226*a* and a second or lower bearing assembly 226*b*. As illustrated, the upper bearing assembly 226*a* may be positioned at the uphole end 202*a*, and the lower bearing assembly 226*b* may be positioned at the downhole end 202*b*. Each bearing assembly 226*a,b* may include a bearing housing 228, shown as a first or upper bearing housing 228*a* and a second or lower bearing housing 228*b*. Each bearing housing 228*a,b* may be webbed and otherwise provide a primary flow path 230*a* and a secondary flow path 230*b*. The primary and secondary flow paths 230*a,b* may be configured to receive a flow of a fluid, as shown by the arrows. The fluid may comprise a drilling fluid or "mud" that may be circulated through the turbine assembly 200 from the drill string 106 (FIG. 1).

Each of the upper and lower bearing assemblies 226*a,b* may include a radial bearing 232 to resist radial loads assumed by the rotor shaft 204 and a thrust bearing 234 to resist axial loads assumed by the rotor shaft 204. Each radial bearing 232 may include a rotor shaft component 236*a* and a bearing housing component 236*b*. Likewise, each thrust bearing 234 may include a rotor shaft component 238*a* and a bearing housing component 238*b*. The rotor shaft components 236*a*, 238*a* of the radial and thrust bearings 232, 234, respectively, may be configured to rotate with rotation of the rotor shaft 204. The bearing housing components 236*b*, 238*b*, on the other hand, may be secured to the bearing housing 228 and configured to engage or otherwise interact with the rotor shaft components 236*a*, 238*a*, respectively, during operation.

As illustrated, the rotor shaft components 236*a*, 238*a* of the radial and thrust bearings 232, 234, respectively, may be secured to the rotor shaft 204 using a mechanical fastener 240, shown as a first or upper mechanical fastener 240*a* positioned at the uphole end 202*a*, and a second or lower mechanical fastener 240*b* positioned at the downhole end 202*b*. In some embodiments, the upper mechanical fastener 240*a* may be threaded to the rotor shaft 204 at the uphole end 202*a*, and the lower mechanical fastener 240*b* may be threaded to the rotor shaft 204 at the downhole end 202*b*. As the upper mechanical fastener 240*a* is threaded to the rotor shaft 204 at the uphole end 202*a*, the rotor shaft components 236*a*, 238*a* of the upper bearing assembly 226*a* may be forced against the upper bearing shoulder 210*a*, thereby securing the rotor shaft components 236*a*, 238*a* of the upper bearing assembly 226*a* to the rotor shaft 204 for rotation therewith. More particularly, as the upper mechanical fastener 240*a* is threaded to the rotor shaft 204, the rotor shaft component 238*a* of the upper thrust bearing 234 may be forced against the rotor shaft component 236*a* of the upper radial bearing 232 and, in turn, the rotor shaft component 236*a* of the upper radial bearing 232 may be forced against the upper bearing shoulder 210*a*. Likewise, as the lower mechanical fastener 240*b* is threaded to the rotor shaft 204 at the downhole end 202*b*, the rotor shaft components 236*a*, 238*a* of the lower bearing assembly 226*b* may be forced against the lower bearing shoulder 210*b*, thereby securing the rotor shaft components 236*a*, 238*a* of the lower bearing assembly 226*b* to the rotor shaft 204 for rotation therewith. More particularly, the rotor shaft component 238*a* of the thrust bearing 234 may be forced against the rotor shaft component 236*a* of the radial bearing 232 and, in turn, the rotor shaft component 236*a* of the radial bearing 232 may be forced against the lower bearing shoulder 210*b*.

In other embodiments, rotor shaft components 236*a*, 238*a* of the radial and thrust bearings 232, 234 may be preloaded and otherwise secured to the rotor shaft 204 in other ways. For instance, the radial and thrust bearings 232, 234 may be preloaded on the rotor shaft 204 by shrink fitting, using one or more localized mechanical fasteners (e.g., screws, bolts, pins, lock rings, etc.), by welding or brazing, an industrial adhesive, or any combination of the foregoing methods and/or means.

As will be appreciated, securing the rotor shaft components 236*a*, 238*a* against the upper and lower bearing shoulders 210*a,b* may preload the radial and thrust bearings 232, 234 through the rotor shaft 204 as opposed to applying compressive forces to the rotor blades 222. As a result, the rotor shaft 204 may be able to "float" between the upper and lower bearing assemblies 226*a,b*, depending upon which way thrust loads are being assumed by the turbine assembly 200 during operation, and any gap between the rotor shaft 204 and the bearing assemblies 226*a,b* may be completely independent of the individual changes in tolerance of the stator blades 216 and the rotor blades 222. Likewise, as discussed above, the stator blades 216 may be secured within the stator housing 214 using a compressive load against the stator shoulder 220, which preloads the upper and lower bearing housings 228*a,b*, and, therefore, the radial and thrust bearings 232, 234 associated therewith, against the stator housing 214. As a result, the thrust bearings 234 may be installed without the stator blades 216 affecting the distance between the bearing surfaces.

Accordingly, the design of the turbine assembly 200 may be configured to mitigate any bearing stack-up issues surrounding the individual turbine stages of the turbine assembly 200, thereby rendering the turbine assembly 200 as a modular unit. In other words, once fully assembled, all the rotating components and stationary components of the turbine assembly 200 may be handled as a single, transportable unit. The modular design and careful bearing stack-up allow the turbine assembly 200 to be assembled easily without the need for sensitive and time-consuming procedures, or measuring or shimming. As will be appreciated, this may help reduce assembly costs since sensitive procedures typically followed in conventional turbine assemblies are obviated and the likelihood for operator error is reduced. Another advantage includes the ability to easily swap out the turbine assembly 200 for a turbine assembly with a different configuration. This may prove advantageous in allowing a well operator the ability to select and install a turbine assembly designed to operate under specific downhole conditions for a variety of downhole operations.

In some embodiments, as illustrated, the radial and thrust bearings 232, 234 may be positioned within the secondary flow path 230*b* such that an amount of the fluid may pass therethrough. Fluid flow through the secondary flow path 230*b* may prove advantageous in cooling and otherwise lubricating the radial and thrust bearings 232, 234 during operation. A variety of types of bearings may be used as the radial and thrust bearings 232, 234. For instance, one or both of the radial and thrust bearings may comprise, but are not limited to, ball bearings, needle bearings, marine bearings, and the like. In other embodiments, the radial and thrust bearings 232, 234 may comprise marine bearings or oil lubricated bearings.

In yet other embodiments, as illustrated, the radial and thrust bearings 232, 234 may comprise bearings made of an ultra-hard material, such as polycrystalline diamond (PDC), polycrystalline cubic boron nitride, or impregnated diamond. In the illustrated embodiment, the radial and thrust bearings 232, 234 are each depicted as comprising PDC bearings, where the bearing housing components 236*b*, 238*b* each comprise one or more PDC discs or "pucks" coupled to the bearing housing 228*a,b*. In such embodiments, the PDC discs may be secured (e.g., brazed) to the body of the bearing housing 228*a,b* or a substrate 242 that may be press-fit into the bearing housing 228*a,b*. The substrate 242 may be made of a hard material, such as tungsten carbide.

Likewise, the rotor shaft component 236*a* of the radial bearing 232 may comprise one or more PDC discs brazed or otherwise secured to the rotor shaft 204 or a suitable substrate (e.g., a tungsten carbide substrate) that may be coupled thereto. In some embodiments, the rotor shaft component 236*b* of the thrust bearing 234 may be an annular structure made of an ultra-hard material (e.g., PDC, polycrystalline cubic boron nitride, impregnated diamond, etc.) or may otherwise include one or more layers of an ultra-hard material plated thereon. During operation, the rotor shaft component 236*b* of the thrust bearing 234 may be configured to engage and otherwise interact with the bearing housing component 238*b* to mitigate thrust loads assumed by the rotor shaft 204.

In the illustrated embodiment, a primary or greater flow of the fluid may circulate around the radial and thrust bearings 232, 234 via the primary flow path 230*a*, while a secondary or smaller flow of the fluid may circulate through the secondary flow path 230*b*. The secondary flow path 230*b* may be characterized as a leak path that allows a metered amount of the fluid to pass therethrough to cool and lubricate the radial and thrust bearings 232, 234. As will be appreciated, since the secondary flow path 230*b* provides a lower flow rate past the radial and thrust bearings 232, 234, any damage that might occur through fluid flow over long periods of time may be mitigated. Rather, most erosion damage (if any) may be sustained by the bearing housing 228*a,b* itself in the primary flow path 230*a*, rather than to the radial and/or thrust bearings 232, 234 in the secondary flow path 230*b*. In the event that erosion damage occurs, the bearing housing(s) 228*a,b* may be removed, rehabilitated, or otherwise replaced, or the radial and/or thrust bearings 232, 234 may be removed from the bearing housing 228*a,b* and the bearing housing components 236*b*, 238*b* may be replaced or rehabilitated. In some embodiments, the bearing housing substrate 242 may be press-fit out of the bearing housing(s) 228*a,b* and replaced with a rehabilitated or new substrate 242.

While not illustrated, it is contemplated herein to arrange the radial and/or thrust bearings 232, 234 in the primary flow path 230*a* in at least one embodiment. While potentially exposing the radial and/or thrust bearings 232, 234 to erosion damage, such an embodiment may prove advantageous in allowing more space within the bearing assemblies 226*a,b* for larger radial and/or thrust bearings 232, 234 that exhibit larger contact areas and are thereby able to assume larger loads.

In the illustrated embodiment, the rotor shaft component 238*a* of the thrust bearings 234 is shown mounted as an outer bearing. As will be appreciated, this will allow the turbine assembly 200 to load on the upper thrust bearing 234 by applying a thrust load downward. In such cases, the thrust load will place the rotor shaft 204 in tension. In other embodiments, however, the position of the rotor shaft component 238*a* of the thrust bearings 234 may be reversed such that they operate as inner bearings. In such embodiments, the rotor shaft component 238*a* of the thrust bearings 234 may be forced against the upper and lower bearing shoulder 210*a,b* in securing the rotor shaft components 236*a,b* to the rotor shaft 204. As will be appreciated, this will allow the turbine assembly 200 to place thrust loads on the lower thrust bearings 234. In such cases, the thrust load will place the rotor shaft 204 in compression.

Accordingly, the turbine assembly 200 is contemplated herein having a rotor shaft 204 that operates either in compression or in tension. Depending on which condition is favorable in the given design, either state may be chosen. Having a compression or tension effect on the rotor shaft 204 may either relieve extra stress or help secure the rotor blades 222 better, depending on the desired effect. As will be appreciated, it may prove advantageous to assume the thrust load at the uphole end 202*a* of the turbine assembly 200, and thereby provide a turbine assembly 200 that is more stable and less prone to whirling and/or other eccentric effects.

As illustrated, the turbine assembly 200 may be installed within a flow tube 244. The flow tube 244 may be any tubular component of the drill string 106 (FIG. 1) or tool string 116 (FIG. 1). In some embodiments, for instance, the flow tube 244 may be a length of drill pipe or a drill collar forming part of the drill string 106 and/or tool string 116. In other embodiments, the flow tube 244 may be in fluid communication with the drill string 106 and/or the tool string 116 such that a flow of the drilling fluid may circulate through the flow tube 244 and, in turn, the turbine assembly 200. The stator housing 214 and the upper and lower bearing housings 228*a,b* may be sized such that they can be inserted into the flow tube 244 for installation.

The turbine assembly 200 may be secured within the flow tube 244 using a coupling 246 positioned at or near the downhole end 202*b* of the turbine assembly 200. In some embodiments, the coupling 246 may be threaded into the flow tube 244. As the coupling 246 is threaded into the flow tube 244, a compressive load may be applied to the stator housing 214 and the upper and lower bearing housings 228*a,b* and the upper bearing housing 228*a* may be forced against a flow tube shoulder 248 defined on the inner surface of the flow tube 244. It will be appreciated, however, that the position of the coupling 246 may be reversed in some embodiments, and the compressive load may alternatively force the lower bearing housing 228*b* against the flow tube shoulder 248.

As indicated above, the turbine assembly 200 may prove advantageous in minimizing the bearing stack-up through the multiple turbine stages. This may be accomplished by loading the radial and thrust bearings 232, 234 through the rotor shaft 204 instead of through the stator housing 214 and/or the stator blades 216. By pre-loading the radial and thrust bearings 232, 234 at the upper and lower bearing shoulders 210*a,b*, the bearing separation gap can be controlled. Other solutions for this may include designing each turbine stage to be axially longer, but with radially shorter stator and rotor blades 216, 222. As will be appreciated, this may allow the rotor shaft 204 to move further and account for any increased bearing gap.

Optimizing the bearing stack-up may also allow the turbine assembly 200 to be more simply coupled to a driven component (not shown). More particularly, with the axial travel of the rotor shaft 204 minimized, one or both of the upper and lower mechanical fasteners 240*a,b* may be configured to be coupled to a driven component, such as a generator, a gearbox, an alternator, a steering mechanism, or any other mechanism that requires or operates based on rotational power. In such embodiments, one or both of the upper and lower mechanical fasteners 240*a,b* may comprise an output coupling such as, but not limited to, a magnetic coupling, a threaded coupling, or a spline coupling configured to couple the turbine assembly 200 to one or more driven components at each axial end.

In some embodiments, one end of the rotor shaft 204 may extend into one of the driven components, such as a driven component that is filled with oil or another hydraulic fluid. In such embodiments, the radial and thrust bearings 232, 234 may comprise roller bearings or the like and a metal seal may prevent migration of the oil out of the driven component at the interface with the rotor shaft 204. Accordingly, with minimized axial travel of the rotor shaft 204, it may be possible to have one or more sealed sections on either axial end of the rotor shaft, and the radial and/or thrust bearings 232, 234 may be placed in an oil-filled cavity.

Embodiments disclosed herein include:

A. A downhole turbine assembly that includes a stator housing having one or more stator blades positioned within the stator housing and extending radially inward therefrom, a rotor shaft rotatably positioned within the stator housing and having a first portion exhibiting a first diameter and a second portion exhibiting a second diameter greater than the first diameter, the first portion including an upper first portion provided at a first end of the rotor shaft and terminating at an upper bearing shoulder and a lower first portion provided at a second end of the rotor shaft and terminating at a lower bearing shoulder, one or more rotor blades secured to the second portion for rotation with the rotor shaft and being interleaved with the one or more stator blades, and a first bearing assembly positioned at the first end and a second bearing assembly positioned at the second end, the first and second bearing assemblies each including a bearing housing, one or more radial bearings, and one or more thrust bearings, wherein at least one of the bearing housings provides a primary flow path and a secondary flow path, and wherein the one or more radial bearings and the one or more thrust bearings are arranged in the secondary flow path.

B. A method that includes circulating a fluid to a downhole turbine assembly, the downhole turbine assembly including a stator housing having one or more stator blades positioned within the stator housing and extending radially inward therefrom, and a rotor shaft rotatably positioned within the stator housing and having a first portion exhibiting a first diameter and a second portion exhibiting a second diameter greater than the first diameter, the first portion including an upper first portion provided at a first end of the rotor shaft and terminating at an upper bearing shoulder and a lower first portion provided at a second end of the rotor shaft and terminating at a lower bearing shoulder, and rotating the rotor shaft as the fluid impinges upon one or more rotor blades secured to the second portion of the rotor shaft, assuming radial and thrust loads on the rotor shaft with a first bearing assembly positioned at the first end and a second bearing assembly positioned at the second end, the first and second bearing assemblies each including a bearing housing, one or more radial bearings, and one or more thrust bearings, wherein at least one of the bearing housings provides a primary flow path and a secondary flow path, and flowing a first portion of the fluid through the primary flow path, and flowing a second portion of the fluid through the secondary flow path, wherein the one or more radial bearings and the one or more thrust bearings are arranged in the secondary flow path.

Each of embodiments A and B may have one or more of the following additional elements in any combination: Element 1: wherein the one or more radial bearings and the one or more thrust bearings each include a rotor shaft component, the turbine assembly further comprising a first mechanical fastener secured to the first end of the rotor shaft to preload the rotor shaft components of the upper bearing assembly against the upper bearing shoulder, and a second mechanical fastener secured to the second end of the rotor shaft to preload the rotor shaft components of the lower bearing assembly against the lower bearing shoulder. Element 2: wherein at least one of the first and second mechanical fasteners is an output coupling that operatively couples the rotor shaft to a driven component. Element 3: further comprising a stator lock ring that secures the one or more stator blades within the stator housing, wherein the stator lock ring preloads the one or more stator blades against a stator shoulder defined on an inner radial surface of the stator housing. Element 4: wherein the one or more rotor blades are secured to the second portion of the rotor shaft with a rotor lock ring that forces the one or more rotor blades against a rotor shoulder defined on the rotor shaft. Element 5: wherein at least one of the one or more rotor blades is keyed to the second portion of the rotor shaft. Element 6: wherein rotor shaft exhibits a polygonal cross-sectional shape and the one or more rotor blades are shaped to mate with the polygonal cross-sectional shape to secure the one or more rotor blades to the second portion. Element 7: wherein axially adjacent mating faces of two or more of the one or more rotor blades interlock to prevent relative rotation. Element 8: wherein one or both of the plurality of stators and the plurality of rotors are clocked. Element 9: wherein the primary and secondary flow paths receive a fluid and the primary flow path receives a greater flow of the fluid as compared to the secondary flow path. Element 10: wherein at least one of the one or more radial bearings and the one or more thrust bearings comprises a bearing made of an ultra-hard material. Element 11: wherein the at least one of the one or more radial bearings and the one or more thrust bearings is a polycrystalline diamond (PDC) bearing comprising one or more PDC discs. Element 12: further comprising a substrate coupled to the bearing housing, wherein the one or more PDC discs are brazed into the substrate. Element 13: wherein at least one of the one or more radial bearings and the one or more thrust bearings comprises a bearing selected from the group consisting of a ball bearing, a needle bearing, a marine bearing, an oil lubricated bearing, and any combination thereof. Element 14: further comprising a flow tube that defines a flow tube shoulder, wherein the stator housing and the bearing housings of the first and second bearing assemblies are each sized to be inserted into the flow tube and preloaded against the flow tube shoulder with a coupling.

Element 15: wherein the one or more radial bearings and the one or more thrust bearings each include a rotor shaft component, the method further comprising preloading the rotor shaft components of the upper bearing assembly against the upper bearing shoulder by securing a first mechanical fastener secured to the first end of the rotor shaft, and preloading the rotor shaft components of the lower bearing assembly against the lower bearing shoulder by securing a second mechanical fastener secured to the second end of the rotor shaft. Element 16: wherein at least one of the first and second mechanical fasteners is an output coupling, the method further comprising operatively coupling the rotor shaft to a driven component via the output coupling, and transmitting rotational energy to the driven component via the output coupling. Element 17: further comprising a stator lock ring that secures the one or more stator blades within the stator housing, wherein the stator lock ring preloads the one or more stator blades against a stator shoulder defined on an inner radial surface of the stator housing. Element 18: further comprising securing the one or more rotor blades to the second portion of the rotor shaft with a rotor lock ring that forces the one or more rotor blades against a rotor shoulder defined on the rotor shaft. Element 19: wherein circulating the fluid to the downhole turbine assembly is preceded by introducing the downhole turbine assembly into a flow tube that defines a flow tube shoulder, and securing the downhole turbine assembly within the flow tube with a coupling that preloads the stator housing and the bearing housings of the first and second bearing assemblies against the flow tube shoulder.

By way of non-limiting example, exemplary combinations applicable to A, B, and C include: Element 1 with Element 2; Element 10 with Element 11; Element 11 with Element 12; and Element 15 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A downhole turbine assembly, comprising:

a stator housing having one or more stator blades positioned within the stator housing and extending radially inward therefrom;

a rotor shaft rotatably positioned within the stator housing and having an upper portion provided at a first end of the rotor shaft and defining an upper bearing shoulder, a lower portion provided at a second end of the rotor shaft and defining a lower bearing shoulder, and an intermediate portion between the first end and the second end;

one or more rotor blades secured to the intermediate portion for rotation with the rotor shaft and being interleaved with the one or more stator blades; and a first bearing assembly positioned at the first end and a second bearing assembly positioned at the second end, the first and second bearing assemblies each including a bearing housing, one or more radial bearings disposed in the bearing housing, and one or more thrust bearings disposed in the bearing housing, wherein at least one of the bearing housings provides a primary flow path and a secondary flow path, and wherein the secondary flow path extends through the one or more radial bearings and the one or more thrust bearings.

2. The downhole turbine assembly of claim 1, wherein the one or more radial bearings and the one or more thrust bearings each include a rotor shaft component, the turbine assembly further comprising:

a first mechanical fastener secured to the first end of the rotor shaft to preload the rotor shaft components of the first bearing assembly against the upper bearing shoulder; and a second mechanical fastener secured to the second end of the rotor shaft to preload the rotor shaft components of the second bearing assembly against the lower bearing shoulder.

3. The downhole turbine assembly of claim 2, wherein at least one of the first and second mechanical fasteners is an output coupling that operatively couples the rotor shaft to a driven component.

4. The downhole turbine assembly of claim 1, further comprising a stator lock ring that secures the one or more stator blades within the stator housing, wherein the stator lock ring preloads the one or more stator blades against a stator shoulder defined on an inner radial surface of the stator housing.

5. The downhole turbine assembly of claim 1, wherein the one or more rotor blades are secured to the intermediate portion of the rotor shaft with a rotor lock ring that forces the one or more rotor blades against a rotor shoulder defined on the rotor shaft.

6. The downhole turbine assembly of claim 1, wherein at least one of the one or more rotor blades is keyed to the intermediate portion of the rotor shaft.

7. The downhole turbine assembly of claim 1, wherein rotor shaft exhibits a polygonal cross-sectional shape and the one or more rotor blades are shaped to mate with the polygonal cross-sectional shape to secure the one or more rotor blades to the intermediates portion.

8. The downhole turbine assembly of claim 1, wherein the one or more rotor blades comprises two or more rotor blades and axially adjacent mating faces of the two or more rotor blades interlock to prevent relative rotation.

9. The downhole turbine assembly of claim 1, wherein one or both of the one or more stator blades and the one or more rotor blades are clocked.

10. The turbine assembly of claim 1, wherein the primary and secondary flow paths receive a fluid and the primary flow path receives a greater flow of the fluid as compared to the secondary flow path.

11. The downhole turbine assembly of claim 1, wherein at least one of the one or more radial bearings and the one or more thrust bearings comprises a bearing made of an ultra-hard material.

12. The downhole turbine assembly of claim 11, wherein the at least one of the one or more radial bearings and the one or more thrust bearings is a polycrystalline diamond (PDC) bearing comprising one or more PDC discs.

13. The downhole turbine assembly of claim 12, further comprising a substrate coupled to the bearing housing, wherein the one or more PDC discs are brazed into the substrate.

14. The downhole turbine assembly of claim 1, wherein at least one of the one or more radial bearings and the one or more thrust bearings comprises a bearing selected from the group consisting of a ball bearing, a needle bearing, a marine bearing, an oil lubricated bearing, and any combination thereof.

15. The downhole turbine assembly of claim 1, further comprising a flow tube that defines a flow tube shoulder, wherein the stator housing and the bearing housings of the first and second bearing assemblies are each sized to be inserted into the flow tube and preloaded against the flow tube shoulder with a coupling.

16. A method, comprising:

circulating a fluid to a downhole turbine assembly, the downhole turbine assembly including:

a stator housing having one or more stator blades positioned within the stator housing and extending radially inward therefrom; and a rotor shaft rotatably positioned within the stator housing and having an upper portion provided at a first end of the rotor shaft and defining an upper bearing shoulder, a lower portion provided at a second end of the rotor shaft and defining a lower bearing shoulder, and an intermediate portion between the first end and the second end;

rotating the rotor shaft as the fluid impinges upon one or more rotor blades secured to the intermediate portion of the rotor shaft between the first end and the second end;

assuming radial and thrust loads on the rotor shaft with a first bearing assembly positioned at the first end and a second bearing assembly positioned at the second end, the first and second bearing assemblies each including a bearing housing, one or more radial bearings disposed in the bearing housing, and one or more thrust bearings disposed in the bearing housing, wherein at least one of the bearing housings provides a primary flow path and a secondary flow path; and flowing a first portion of the fluid through the primary flow path, and flowing a second portion of the fluid through the secondary flow path, wherein the one or more radial bearings and the one or more thrust bearings are arranged in the secondary flow path.

17. The method of claim 16, wherein the one or more radial bearings and the one or more thrust bearings each include a rotor shaft component, the method further comprising:

preloading the rotor shaft components of the first bearing assembly against the upper bearing shoulder by securing a first mechanical fastener secured to the first end of the rotor shaft; and preloading the rotor shaft components of the second bearing assembly against the lower bearing shoulder by securing a second mechanical fastener secured to the second end of the rotor shaft.

18. The method of claim 17, wherein at least one of the first and second mechanical fasteners is an output coupling, the method further comprising:

operatively coupling the rotor shaft to a driven component via the output coupling; and transmitting rotational energy to the driven component via the output coupling.

19. The method of claim 16, further comprising a stator lock ring that secures the one or more stator blades within the stator housing, wherein the stator lock ring preloads the one or more stator blades against a stator shoulder defined on an inner radial surface of the stator housing.

20. The method of claim 16, further comprising securing the one or more rotor blades to the intermediate portion of the rotor shaft with a rotor lock ring that forces the one or more rotor blades against a rotor shoulder defined on the rotor shaft.

21. The method of claim 16, wherein circulating the fluid to the downhole turbine assembly is preceded by:

introducing the downhole turbine assembly into a flow tube that defines a flow tube shoulder; and securing the downhole turbine assembly within the flow tube with a coupling that preloads the stator housing and the bearing housings of the first and second bearing assemblies against the flow tube shoulder.

* * * * *